US008272558B2

(12) United States Patent
Groch

(10) Patent No.: US 8,272,558 B2
(45) Date of Patent: Sep. 25, 2012

(54) SUSPENSION FILE

(75) Inventor: Hans Werner Groch, Stuttgart (DE)

(73) Assignee: Esselte Leitz GmbH & Co KG, Stuttgart (DE)

( * ) Notice: Subject to any disclaimer, the term of this patent is extended or adjusted under 35 U.S.C. 154(b) by 284 days.

(21) Appl. No.: 12/450,969

(22) PCT Filed: Apr. 14, 2008

(86) PCT No.: PCT/EP2008/054467

§ 371 (c)(1),
(2), (4) Date: Oct. 20, 2009

(87) PCT Pub. No.: WO2008/132039

PCT Pub. Date: Nov. 6, 2008

(65) Prior Publication Data

US 2010/0045021 A1 Feb. 25, 2010

(30) Foreign Application Priority Data

Apr. 27, 2007 (DE) ..... 10 2007 020 408

(51) Int. Cl.
*B65D 27/00* (2006.01)

(52) U.S. Cl. ..... 229/67.2

(58) Field of Classification Search ..... 229/67.1–67.4; 312/184; 40/359

See application file for complete search history.

(56) References Cited

U.S. PATENT DOCUMENTS 2,528,485 A 11/1950 Chenouard
4,204,639 A * 5/1980 Barber et al. ..... 235/488
4,523,776 A * 6/1985 Barber ..... 283/39
4,580,815 A * 4/1986 Barber ..... 283/81
4,588,463 A 5/1986 Barber et al.
4,749,121 A * 6/1988 Barber et al. ..... 229/67.1
4,966,639 A 10/1990 Pfeffer et al.
5,016,370 A * 5/1991 Rhian et al. ..... 40/359
5,161,731 A * 11/1992 Rivlin et al. ..... 229/67.3
5,256,130 A 10/1993 Kachel et al.

(Continued)

FOREIGN PATENT DOCUMENTS

CH 339 908 7/1959

(Continued)

OTHER PUBLICATIONS

International Search Report.

(Continued)

*Primary Examiner* — Jes F Pascua
(74) *Attorney, Agent, or Firm* — Collard & Roe, P.C.

(57) ABSTRACT

The invention relates to a suspension file (10, 110) for accepting documents, comprising a web (12) made of foldable material with two top edges (14) and two lateral edges (16) which interconnect the top edges (14). The web (12) is folded on a bottom (20) of the file so as to form at least one fold (18) and is provided with two sidewalls (22) that extend from the bottom (20) of the file to the top edges (14). Hooks (26) that project from the lateral edges (16) are attached to the top edges (14). The suspension file (10, 110) further comprises at least one reinforcement element (36) which is connected to the web (12) and extends from one top edge (14) to the other along one of the lateral edges (16). According to the invention, the at least one reinforcement element (36) is arranged at a distance from the respective lateral edge (16).

9 Claims, 3 Drawing Sheets

U.S. PATENT DOCUMENTS

Figure 1:
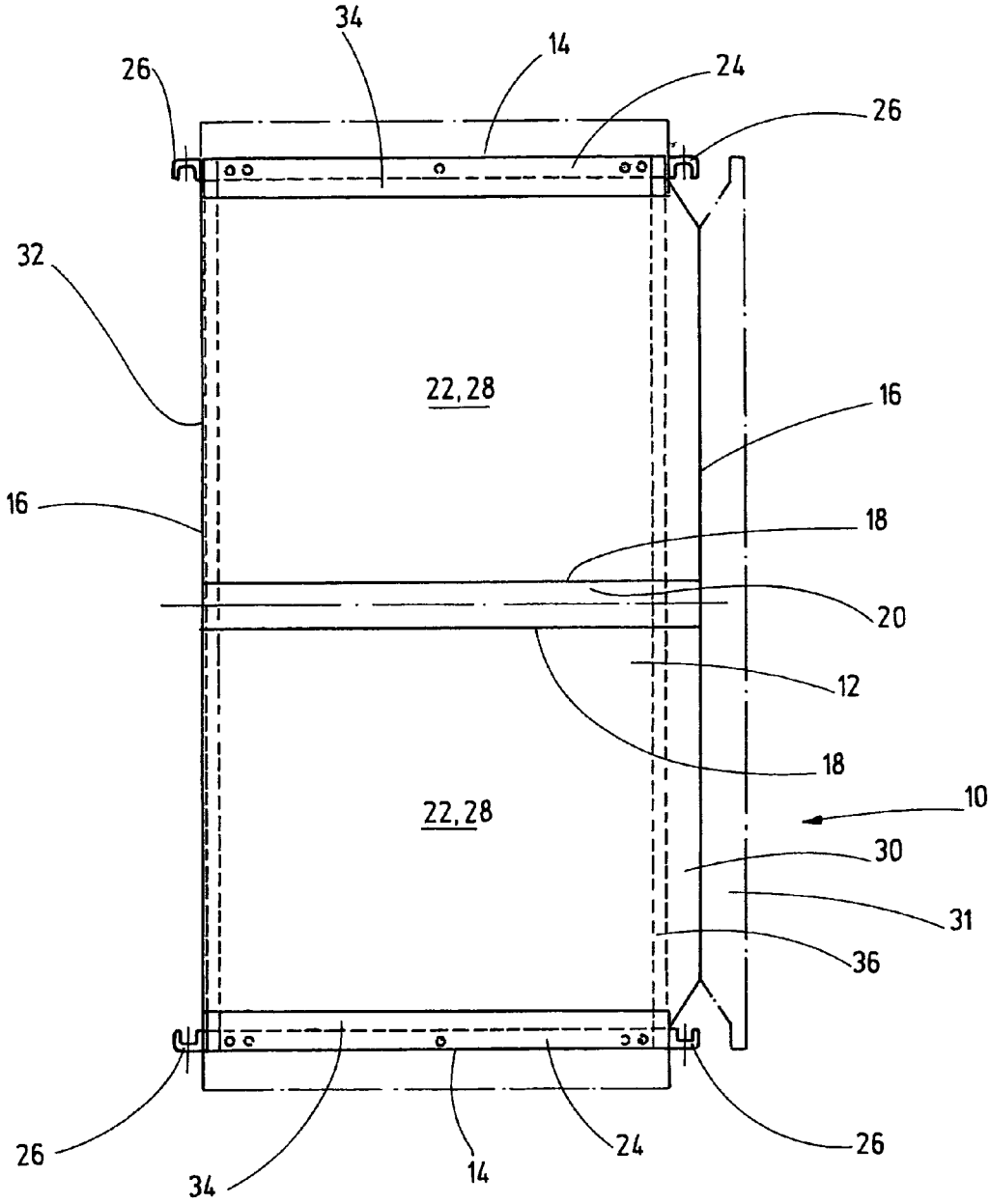

| | | | | | |
|---|---|---|---|---|---|
| 5,261,636 | A | * | 11/1993 | Hawes et al. | 281/45 |
| 5,275,439 | A | * | 1/1994 | Hawes et al. | 281/45 |
| 5,284,362 | A | * | 2/1994 | Kachel et al. | 281/45 |
| 5,720,427 | A | * | 2/1998 | Kachel et al. | 229/67.3 |
| 6,910,622 | B2 | * | 6/2005 | Mark et al. | 229/67.2 |

FOREIGN PATENT DOCUMENTS

| | | |
|---|---|---|
| GB | 613796 | 12/1948 |

OTHER PUBLICATIONS

German Search Report dated Dec. 18, 2007 along with an English translation of the relevant parts.

English translation of the International Preliminary Report on Patentability and Written Opinion of the International Searching Authority.

* cited by examiner

SUSPENSION FILE

CROSS REFERENCE TO RELATED APPLICATIONS

This application is the National Stage of PCT/EP2008/054467 filed on Apr. 14, 2008, which claims priority under 35 U.S.C. §119 of German Application No. 10 2007 020 408.8 filed on Apr. 27, 2007. The international application under PCT article 21(2) was not published in English.

The invention relates to a hanging folder for accommodating documents, in accordance with the preamble of claim 1.

Known hanging folders of this type have a web made of paperboard or plastic, particularly polypropylene (PP) or polyvinyl chloride (PVC), which is intended to be suspended in a shelf, a file cabinet, or the like, by means of the hooks attached to it, connected with one another in pairs, by means of rails. In this connection, the hooks, which project laterally, engage into accommodation rails of the file cabinet and carry the weight of the hanging file and the documents accommodated in it. The documents rest on the bottom of the hanging file. In the case of smaller hanging files, this bottom is formed by the fold. In the case of larger hanging files for accommodating larger amounts of documents, the web has two folds, between which part of the web extends as the bottom of the folder. In general, the hanging folders are open at the side edges, so that the accommodation space for the documents is also accessible from the side edges. However, documents are generally placed into or removed from the top, in other words between and through the top edges. In this connection, significant forces act on the bottom of the folder, promoting its wear, particularly if large amounts of documents are falling into the hanging folder at the same time. In order to counter this, it has already been proposed to make the bottom of the folder stronger than the side walls. However, the forces are transferred to the rails and their hooks by way of the side walls, so that the side walls close to the top edges often tear after only short use.

From U.S. Pat. No. 2,528,485 A, a hanging folder made of a web of paper, paperboard, or similar material is known, whereby the web is folded over at the top edges and at the side edges. The folded-over section at the top edges accommodates a wire with hooks, in order to be able to hang the hanging folder. The folded-over sections at the side edges reinforce the hanging folder at these locations. Because of the complicated folding process, however, this hanging folder is complicated in its production.

It is therefore the task of the invention to further develop a hanging folder of the type stated initially, in such a manner that it is easier to produce.

This task is accomplished, according to the invention, by means of a hanging folder having the characteristics of claim 1.

Advantageous further developments are the object of the dependent claims.

The invention is based on the idea that forces that occur in the folder are concentrated in the vicinity of the hooks by means of the reinforcement element or by means of the reinforcement elements, respectively, and that additional moments that occur in the side walls, in the center of the top edges, are thereby reduced. In particular, crosswise and diagonal forces that act on the side walls, in the region of the top edges, in undefined manner, are reduced. The forces that occur when documents are placed in the folder are therefore transferred to the rails, to an increased degree, in the region of the reinforcement element or reinforcement elements, respectively. In this region, however, the side walls are reinforced by the reinforcement element or reinforcement elements, respectively, and therefore able to withstand stress. Each of the reinforcement elements is disposed at a distance from the side edge, in each instance. This brings about a sufficient increase in the stability of the hanging folder, with simultaneously low production effort.

It is possible that the hanging folder has only one reinforcement element along one of the two side edges. However, it is preferred that a reinforcement element extends along each of the two side edges, from one top edge to the other. In this way, the ability of the hanging folder to withstand stress is improved even further, in comparison with the embodiment having only one reinforcement element.

The at least one reinforcement element can be attached on an outside that faces away from the accommodation space for the documents, or on the inside of the web, facing the accommodation space. The effect is essentially the same, independent of the location of placement. The at least one reinforcement element is therefore affixed where it is most easily possible in terms of production technology.

Preferably, the at least one reinforcement element is glued onto the web. In this connection, it can be configured, in particularly simple manner, as an adhesive tape. If the web consists of paperboard, it is also advantageous if the at least one reinforcement element is a paperboard strip.

The at least one reinforcement element advantageously extends beyond at least one of the top edges and then runs at least a short distance further along the other side of the web. It then reinforces the web, at least in certain sections, both on its inside and on its outside, whereby it extends from one top edge to the other on one of these sides.

An alternative embodiment provides that the at least one reinforcement element is integrated into the web. In particular, it can have at least one filament that runs within the web, which advantageously consists of plastic, particularly of nylon, or metal, or also of natural fiber, particularly of wool.

It is practical if the hanging folder has a rail that projects beyond the side edges at each top edge, which carries the hooks, which rail encloses the top edge, and is connected, with shape fit, with the at least one reinforcement element. The shape-fit connection with the reinforcement element imparts greater stability to the hanging folder in comparison with a hanging folder in which the rail is connected only with the web.

Figure 2:
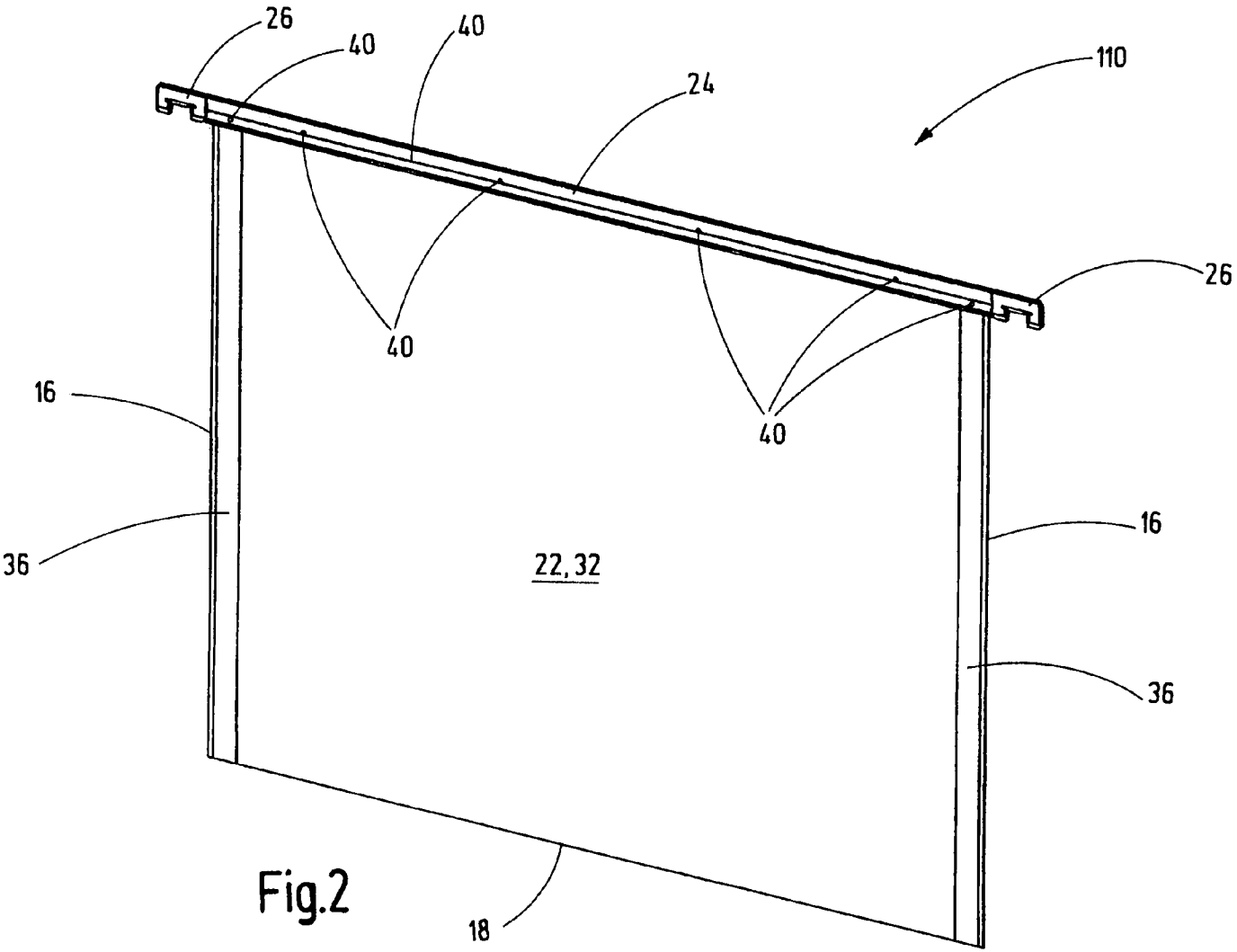
Figure 3:
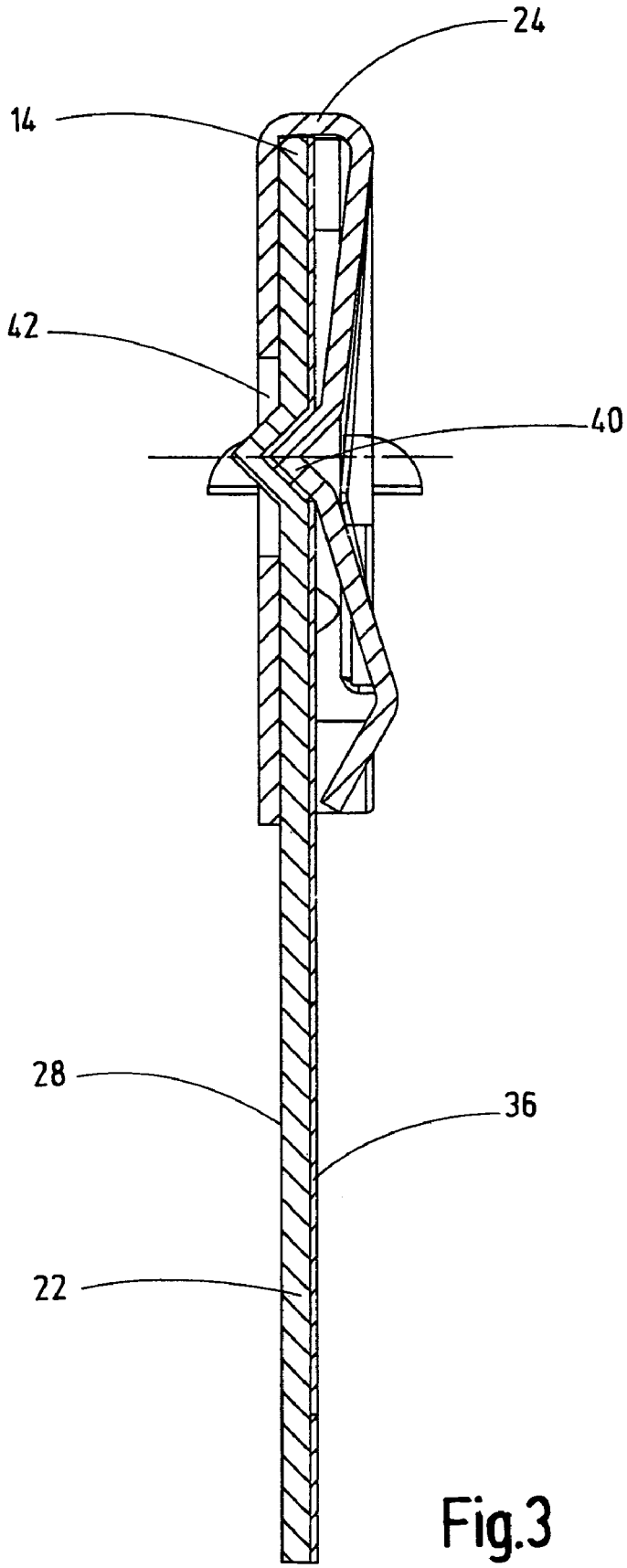

The invention will be described in greater detail in the following, using exemplary embodiments shown schematically in the drawing. The figures show:

FIG. 1 a hanging folder according to a first exemplary embodiment, in the open, unfolded state;

FIG. 2 a hanging folder according to a second exemplary embodiment, in the folded state, in a perspective view; and FIG. 3 a section through the upper region of one of the side walls of the hanging folder of FIG. 2.

A hanging folder 10 for documents has a web 12 made of foldable material, paperboard in the present case. The web 12 has two top edges 14 disposed at a distance from one another, as well as side edges 16 that connect the top edges 14 with one another. Approximately in the center of the web 12, two folds 18 between the side edges 16 run at a distance from one another. The folds 18 form the parting line between a folder bottom 20 and two side walls 22, which end at the top edges 14. At the top edges 14, a rail 24 having hooks 26 disposed at the ends is attached, in each instance, which project beyond the side walls 16. The hanging folder 10 is suspended in the accommodation rails of a file cabinet on the hooks 26. An accommodation space for the documents, delimited by the insides 28 of the side walls 22 and of the folder bottom 20 shown in FIG. 1, is accessible from the top when the hanging folder 10 is suspended in the file cabinet. At the same time, the hanging folder 10 is also open at the side edges 16, so that documents can be placed into it from the side, as well. On the right side in FIG. 1, the web 12 has a side strip 30, which is folded along the right side edge 16, as indicated by a dot-dash line, until a right part 31 lies on the outside 32, which faces away from the inside 28. The two parts of the side strip 30 are glued to one another, so that the hanging folder 10 is reinforced at the right side edge 16. Documents can therefore be placed into the accommodation space from this side, whereby the side strip 30 acts as an insertion aid. In the region of the hooks 26, the width of the side strip 30 decreases toward the top edges 14, so that the hooks 26 project beyond the side edge 16 also on the right side. The web 12 is also folded at the top edges 14, whereby top strips 34 are glued onto the inside 28. The rail 24 is inserted between the top strip 34 and the side walls 22.

Flexible reinforcement elements in the form of two adhesive tapes 36 made of plastic are glued onto the outside 32 along the side edges 16. These elements run from one top edge 14 to the other, at a distance from the side edges 16. In this connection, the distance of the left adhesive tape from the left side edge 16 is less than that of the right adhesive tape from the right side edge 16, at which the tape is disposed underneath the folded-over part of the side strip 30 and therefore not visible. However, it is also possible that the adhesive tape 36 is glued on even farther removed from the side edge 16 on the right side, so that it is visible to the observer. The adhesive tapes 36 reinforce the side walls 22 and ensure that the weight forces of the documents placed in the folder, which act on the folder bottom 20, are transferred to the rails 24 in the vicinity of the hooks 26. The folder bottom 20 is also reinforced and constructed of double-ply paperboard.

The hanging folder 110 according to the second exemplary embodiment (FIG. 2) is constructed identically with regard to many details, so that the same reference symbols are used. It differs from the first exemplary embodiment essentially in two points: For one thing, it does not have any side strips 30. For another, the rail 24 that carries the hooks 26 is configured to be V-shaped in cross-section, and set onto the side walls 22 at the top edges 14. Attachment of the rails 24 to the side walls 22 takes place by means of deformation of the rail 24 and clamping the side walls 22 at multiple stamping points 40. These are pressed into the web 12 with shape fit. Lying opposite them, the rails 24 have a window 42, in each instance, through which the stamping point 40 presses the web 12 a certain distance. In place of the window 42, a curvature toward the outside can also be provided, for example, which is structured approximately complementary to the stamping point 40, so that the web 12 is pressed into the curvature. In the second exemplary embodiment, too, the web 12 is made from paperboard. However, it is also possible to use a web made of polypropylene or of polyvinyl chloride, onto which the rails are welded. It is also possible to affix individual hooks that are not connected with one another by means of a rail. The hanging folder 110 according to the second exemplary embodiment also has adhesive tapes 36 that run on the outside 32 of the web from one top edge 14 to the other, glued onto the side walls 22, at a distance from the side edges 16, as reinforcement elements. One of the stamping points 40, in each instance, is pressed into one of the adhesive tapes 36 with shape fit, as shown in FIG. 3.

In summary, the following should be stated:

The invention relates to a hanging folder 10, 110 for accommodating documents, which has a web 12 made of foldable material, having two top edges 14 and two side edges 16 that connect the top edges 14 with one another, that is folded at a folder bottom 20, forming at least one fold 18, and that has two side walls 22 that extend from the folder bottom 20 to the top edges 14, whereby hooks 26 that project beyond the side edges 16, in each instance, are attached at the top edges 14. The hanging folder 10, 110 has at least one reinforcement element 36 connected with the web 12, which extends along one of the side edges 16 from one top edge 14 to the other. According to the invention, the at least one reinforcement element 36 is disposed at a distance from the side edge 16, in each instance.

The invention claimed is:

1. A hanging folder for accommodating documents, which has a web made of foldable material, having two top edges and two side edges that connect the top edges with one another, that is folded at a folder bottom, forming at least one fold, and that has two side walls that extend from the folder bottom to the top edges, whereby hooks that project beyond the side edges, in each instance, are attached at the top edges, whereby at least one reinforcement element connected with the web extends along one of the side edges from one top edge to the other, wherein all of the at least one reinforcement element is disposed at a distance from the side edge, in each instance, and wherein a rail projects beyond the side edges, carries the hooks, is attached at each top edge, encloses the top edge, and is connected, with shape fit, with the at least one reinforcement element.

2. The hanging folder according to claim 1, wherein the at least one reinforcement element extends from one top edge to the other along each of the two side edges.

3. The hanging folder according to claim 1, wherein the at least one reinforcement element is attached to an outside of the web that faces away from an accommodation space for the documents.

4. The hanging folder according to claim 1, wherein the at least one reinforcement element is attached to the inside of the web that faces the accommodation space for the documents.

5. The hanging folder according to claim 1, wherein the at least one reinforcement element is glued onto the web.

6. The hanging folder according to claim 5, wherein the at least one reinforcement element is an adhesive tape.

7. The hanging folder according to claim 5, wherein the web consists of paperboard, and wherein the at least one reinforcement element is a paperboard strip.

8. The hanging folder according to claim 1, wherein the at least one reinforcement element extends beyond at least one of the top edges for at least a short distance along the other side of the web.

9. The hanging folder according to claim 1, wherein the at least one reinforcement element is integrated into the web.

* * * * *